United States Patent [19]

Andersen

[11] Patent Number: 4,981,090

[45] Date of Patent: Jan. 1, 1991

[54] ARRANGEMENT IN A MOVABLE GRATE

[75] Inventor: Hans B. Andersen, / dÅkra, Sweden

[73] Assignee: B & S Miljoteknik A/S, Arhus N, Denmark

[21] Appl. No.: 488,006

[22] PCT Filed: Nov. 11, 1988

[86] PCT No.: PCT/SE88/00605

§ 371 Date: May 14, 1990

§ 102(e) Date: May 14, 1990

[87] PCT Pub. No.: WO89/04441

PCT Pub. Date: May 18, 1989

[30] Foreign Application Priority Data

Nov. 13, 1987 [SE] Sweden ..... 8704461

[51] Int. Cl.[5] ..... F23H 7/10

[52] U.S. Cl. ..... 110/278; 110/257; 110/286; 198/777; 126/152 B; 126/176 R

[58] Field of Search ..... 110/257, 281, 278, 286; 198/777, 773, 774; 126/152 B, 169, 176 R, 181; 414/156

[56] References Cited

U.S. PATENT DOCUMENTS 3,581,684 1/1971 Nobelius et al. ..... 110/257 X 4,793,471 12/1988 Bartels ..... 110/281 X

*Primary Examiner*—Edward G. Favors

*Attorney, Agent, or Firm*—Shapiro and Shapiro

[57] ABSTRACT

A movable grate comprising a number of grate steps which are arranged adjacent each other, partly overlap one another and are pivotable around an axis extending in the longitudinal direction of said grate step, and which are pivotably mounted outside shield members (7, 10) which in lateral direction enclose a combustion chamber, end plates (5) being rigidly secured to the ends of the grate steps and swingable therewith, the end plates being aligned with and fitted in openings in the shield members. The novel matter of the invention resides in that portions (10) of the shield members having such openings aligned with the end plates (5), are displaceably mounted relative to adjoining shield members (7) in the direction of the grate step axis, and that the shield portions (10) which outwardly sealingly engage adjoining shield members (7) and inwardly sealingly engage the end plates (5), are in the direction of said axis rigidly secured to the grate step shaft.

5 Claims, 2 Drawing Sheets

ARRANGEMENT IN A MOVABLE GRATE

The present invention relates to an arrangement of the type stated in the preamble of the claim.

In incinerators, especially for refuse and the like, it is important that the pressure drop through the grate is carefully supervised. It is equally important that the distribution of air across the entire grate is as uniform as possible to prevent that a strong through-flow of air occurs at some locations, while at other locations in which the fuel layer is compact, practically no combustion air passes.

In movable grate incinerators, preferably such as described in Swedish patent specifications 315,679, 316,559 and 338,125, the grate is made up of a number of mutually movable and, more precisely, tiltable steps, each step consisting of a number of bars which are laterally interconnected and supported by a common shaft. Each end of such a step is provided with an end plate adapted to be fitted in an opening in the fixed side shields of the grate. To allow relative pivotal movement of the grate steps partly overlapping one another, the front and the rear edges of the step formed by the grate bars extend beyond the associated end plate and closely follow the side shield as the grate steps move. In the prior art design, a space outside the side shield is used as a duct for secondary air which is blown out at the upper edge of the side shield after having cooled the outside of the side shield and the end plates. This amount of secondary air constitutes part of the amount of air which is supplied under the grate as primary combustion air. The cooling efficiency thus depends to some extent on the amount of primary air which is injected.

Since the length of the shaft changes under the action of heat, the end plates and the outermost grate rods are displaced relative to the side shields, for which reason a free space must be left between the outermost grate rods and the side shields and also at the periphery of the end plates so as to prevent mechanical contact with the side shields and ensuing wear, when the shaft expands. However, these free spaces, although small in themselves, interfere with air supply and pressure drop, when the total area of the free spaces along the grate is so large that the intended air flow cannot be maintained. The air takes the easiest way, i.e. when the free spaces are "large" along the edges of the grate surface where also the fuel layer, as a rule, is thinner than in the centre, and consequently the supply of air along the centre part of the grate will be insufficient, when the grate temperature is low. When the grate has become heated, the grate step shafts have expanded and the free spaces have been substantially eliminated.

The invention aims at completely obviating the shortcomings which are caused by the heat expansion and contraction of the grate step shafts and affect the air supply.

The novel features of the invention are stated in the claims.

Figure 1:
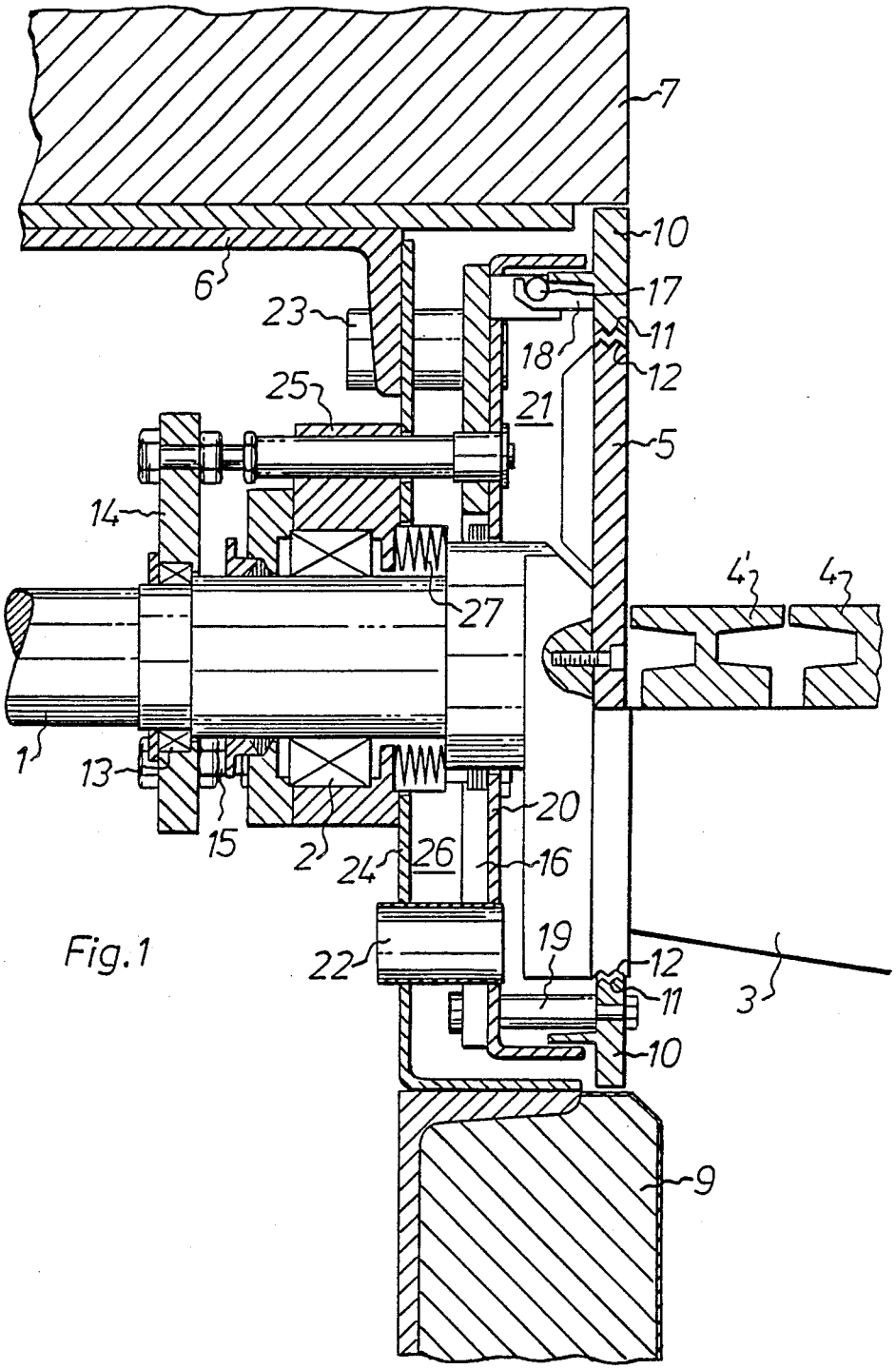
Figure 2:
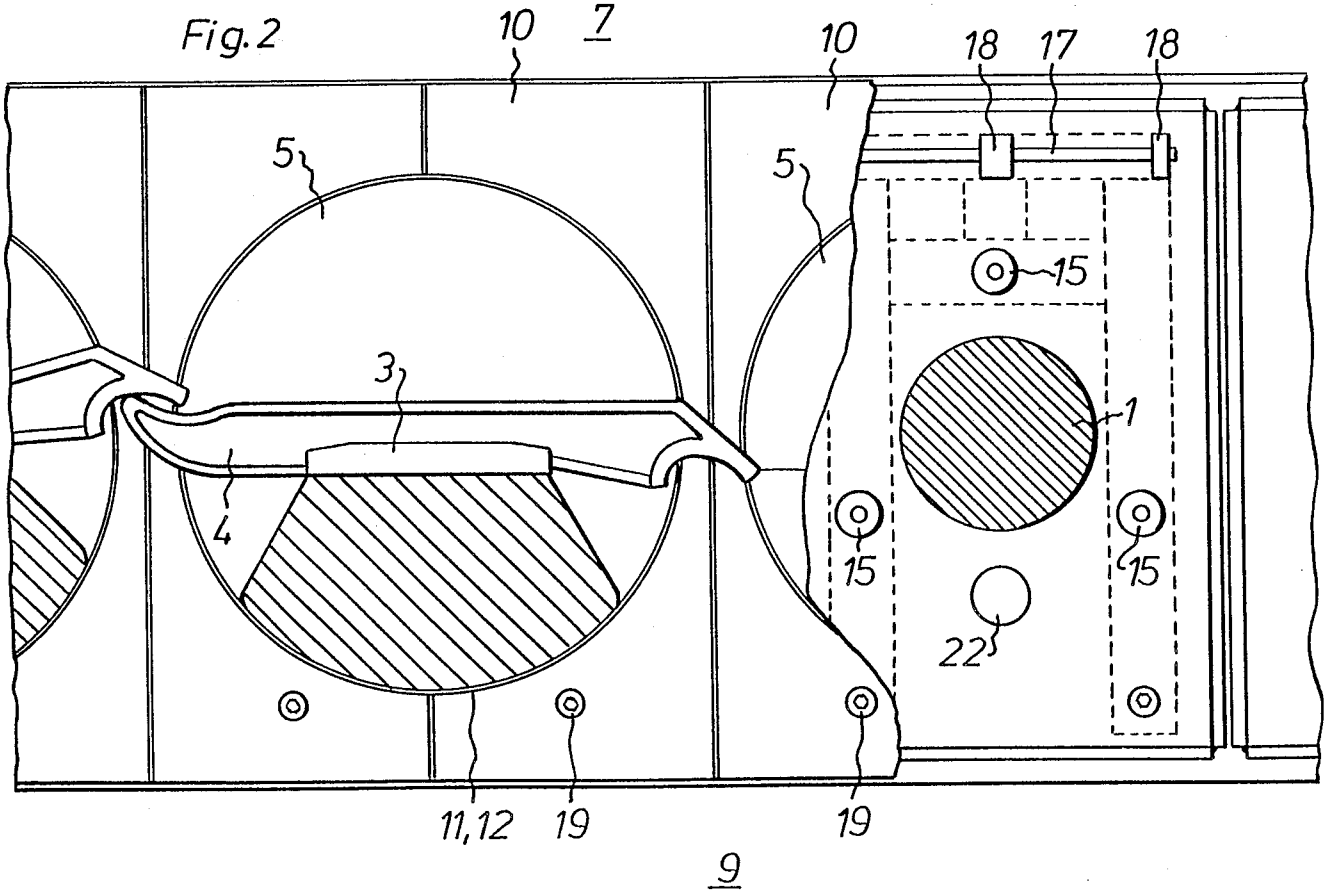

An embodiment will now be described with reference to the accompanying schematic drawings in which FIG. 1 is a cross-sectional view of one side wall of the incinerator in parallel with the grate step shaft, and FIG. 2 shows, partly in section radially through the grate step shaft and on a smaller scale, one side of the incinerator as seen from the inside.

One end of the grate step shaft is designated 1, the shaft being mounted in a manner not described in detail in a grate frame (not shown) by means of a bearing 2 allowing axial movement of the grate shaft. Adjacent the bearing, cup springs are arranged to position the shaft, and a sealing ring enclosing the cup springs. The grate shaft portion 3 extending across the incinerator and radially offset in a crank-like manner relative to the shaft ends 1, carries a number of grate bars 4 forming the grate steps. Adjacent the outermost grate bar 4', an end plate 5 is screwed to the cranked shaft, said end plate following the movement of the grate step. The lower portion of the plate is formed by the flange coupling between the cranked shaft and the centre part.

The side wall of the incinerator is formed by a brick lining 7 supported by a beam 6 and made up of different grades of refractory brick, the brick having the highest resistance and slag-repellency facing the combustion chamber, or the wall of the incinerator consists of elongate tubes which are welded together and coated with refractory brick. Under the grate, funnels are arranged for collecting material falling through the grate and for injecting the primary combustion air.

Previously, use has been made of shield members connected with the end plates 5 and fixedly mounted on the adjoining wall portions, said shield members defining posteriorly situated secondary air ducts and connecting with the ends of the grate bars 4 and the periphery of the end plates 5 by means of fixed free spaces of the type mentioned above.

The novel matter of the invention resides in that shield portions 10 included in the side shield and connected with the end plates 5 are, in the direction of the axis extending in the longitudinal direction of the grate step, rigidly secured to the grate step shaft 1 and provided with one or more labyrinth-shaped grooves and ribs 11 along the edge facing inwardly towards the end plate 5, and that the end plates 5 are provided along their periphery with one or more complementarily designed grooves and ribs 12. As a result, the shield portions 10 will at all times take a fixed position relative to the end plates 5, thereby to enable a very close fit in the labyrinth-shaped joint between the plate and the shield portion.

In the embodiment shown, a further, axially nondisplaceable bearing 13 is mounted on the shaft 1 beyond the supporting bearing 2 and carries a rigid plate 14. Rigid arms 15 of adjustable length extend from the bearing 13 to a yoke-shaped member 16 supporting the shield portions 10. The upper portion of the member 16 is provided with a hinge-like fitting 17 adapted to cooperate with a hook-shaped projection 18 attached to the shield portion 10, while a bolt connection 19 is arranged at the lower portion. The shield portion can thus be hooked on and pivoted downwards to be screwed in position.

When the shaft 1, 3 expands, the end plate 5 is moved to the left in FIG. 1 relative to circumjacent stationary portions of the incinerator wall, i.e. the components 6, 7 and 9, respectively. Since the shield portions 10 are rigidly connected with the shaft 1 via the arms 15, they will participate in the axial movement and follow the end plates.

On the yoke-shaped member 16, there is mounted a box or cassette 20 made of metal sheet and abutting, with close fit, flange projections 21 at the side of the shield portions facing the flange projections. The cassette serves as a duct 21 for the cooling air intended for the shield portions 10 and the end plates 5. The cassette can be formed with a connection to the neighbouring cassettes, such that all cassettes function as a long duct over the entire length of the grate. The cassette can also be formed without connection to the neighbouring cassettes, such that the cooling air is supplied separately to each cassette. The inlet and outlet ducts for the cooling air are designated 22 and 23, respectively.

The stationary partition 24 included in the grate frame is provided with guide means 25 for the arms 15 and can define an outer duct 26 for the cooling air which cools primarily the bearing 2 and the associated cup springs 27 and also the end of the shaft portion 3. The duct 21 and also the duct 26, if any, form a genuine cooling duct, and the air passing therethrough will not, like before, flow into the combustion chamber as secondary air. This means that, independently of the supply of combustion air, adequate cooling of the end plates, shield portions and shaft ends will always be ensured, which, for example during the combustion stages when the supply of secondary air has been reduced, has not been possible in prior art incinerators.

What is claimed is:

1. An arrangement in a movable grate comprising a number of grate steps arranged adjacent each other, partly overlapping each other and preferably formed of grate bars mounted adjacent each other on a shaft (1,3), each grate step being pivotable around an axis extending in the longitudinal direction of the grate step, and being pivotably mounted outside shield members (7,10) which in lateral direction enclose a combustion chamber the bottom of which is formed of the grate (4,4') having combustion air passages, end plates being rigidly secured to the ends of each grate step and swingable therewith, the end plates (5) being aligned with and fitted in openings in said shield members, characterised in that portions (10) of the shield members having such openings aligned with said end plates (5), are displaceably mounted relative to adjoining shield members (7) in the direction of the grate step axis, and that said shield portions (10) which outwardly sealingly engage adjoining shield members (7) and inwardly sealingly engage said end plates (5), are in the direction of said axis rigidly secured to the grate step shaft which is pivotable relative to said shield member portions such that the intended tight sealing engagement between said end plates (5) and ajoining shield member portions (10) is maintained independently of any temperature responsive variation in the length of said grate step and thus of said shaft (1,3) and said end plates (5).

2. The arrangement as claimed in claim 1, characterised in that the shield member portions (10) which connect with said end plates (5) and are displaceable along with the shaft are axially rigidly connected, via adjustable arms (15), with a support means which is arranged at each end of said shaft (1) on both sides of said grate and which, in turn, is supported by the shaft 1 by means of an axially nondisplaceable bearing (13).

3. The arrangement as claimed in claim 1 characterised in that the outwardly facing edges of said end plates (5) and the adjoining opposing edges of the movable shield portions (10) are provided with complementary zig-zag surfaces (11,12) forming a labyrinth-shaped seal.

4. The arrangement as claimed in claim 1, characterised in that the shield portions (10) which are axially displaceable along with the shaft (1,3) and the end plates (5), are connected with box- or cassette-shaped means (20) arranged outside said shield portions (10) as seen from the combustion chamber and enclosing said shaft 1, said means (20) defining, together with the exterior of said end plates (5) and said shield portions (10), a duct-shaped space (21) conducting an air flow cooling said end plate (5) and said shield portions.

5. The arrangement as claimed in claim 2, characterised in that the axially nondisplaceable bearing (13) which, via said arms (15) extending in parallel with the shaft, supports the shield portions (10) displaceable along with said shaft, is arranged outside the main bearing (2) of said shaft (1), which is supported by the grate frame and arranged to allow axial movement of the shaft, and that said arms (15) extend through guide means arranged in the side portion of said grate frame, said guide means preventing turning of the displaceable shield portions along with the shaft (1,3).

* * * * *